United States Patent [19]

Conklin et al.

[11] Patent Number: 4,540,610

[45] Date of Patent: Sep. 10, 1985

[54] HOT MELT SIZE APPLYING

[75] Inventors: Delano M. Conklin, Burlington; John B. Hodgin; Walter F. Illman, both of Greensboro, all of N.C.

[73] Assignee: Burlington Industries, Inc., Greensboro, N.C.

[21] Appl. No.: 430,004

[22] Filed: Sep. 30, 1982

[51] Int. Cl.[3] ..... B05D 1/18; B65H 71/00

[52] U.S. Cl. ..... 427/434.5; 427/434.6; 118/405; 118/420; 118/603; 28/178; 15/256.51

[58] Field of Search ..... 28/178, 179, 180, 181, 28/182, 183; 118/203, 603, 262, 234, 202, DIG. 20, 405, 420; 427/434.6, 434.5; 15/256.51; 264/284, 293, 310, 39; 100/174; 241/112

[56] References Cited

U.S. PATENT DOCUMENTS

| | | | |
|---|---|---|---|
| Re. 29,287 | 7/1977 | Illman et al. | 28/178 |
| 2,209,257 | 7/1940 | Blank | 165/81 |
| 2,797,661 | 7/1957 | Leaming | 118/262 |
| 3,378,876 | 4/1968 | Sisson | 15/256.51 |
| 3,466,717 | 9/1969 | Kuroda | 28/28 |
| 4,119,836 | 10/1978 | Motokawa | 118/261 |
| 4,300,476 | 11/1981 | Jurascheck et al. | 118/694 |
| 4,364,157 | 12/1982 | Cutts | 28/179 |

FOREIGN PATENT DOCUMENTS

| | | | |
|---|---|---|---|
| 308545 | 7/1955 | Switzerland . | |
| 814769 | 6/1959 | United Kingdom . | |
| 0733740 | 5/1980 | U.S.S.R. | 118/262 |

OTHER PUBLICATIONS

"Modern Sizing Processes" by Ernest Sontag, pp. 47 to 57, 1968.

"Dry Sizing of Warps" by Jerzy Zawadzki, pp. 415–417, 1973.

*Primary Examiner*—Norman Morgenstern
*Assistant Examiner*—Ken Jaconetty
*Attorney, Agent, or Firm*—Cushman, Darby & Cushman

[57] ABSTRACT

An apparatus and method effect application of molten size to textile yarns, such as spun yarns. An applicator cylinder is rotatable about a horizontal axis and has a number of grooves circumferentially formed in its surface, with peaked lands between the grooves, each land making an angle of about 8°–12° with respect to a plane bridging the top of an associated groove. A furnisher roll, also rotatable about a horizontal axis, picks up molten size from an open-top trough and delivers it to grooves in the rotating applicator cylinder. The surface of the furnisher roll cooperates with that of the applicator cylinder so that sloping areas of the furnisher roll mate with the lands of the applicator cylinder and so that flat areas of the furnisher roll bridge the entrances to the grooves. The furnisher roll may be of polytetrafluoroethylene machined to correspond to the surface of the applicator cylinder, or may have an elastomeric material surface. A cleaning device comprises a pad, which may be a thermoplastic polymeric material capable of lengthy exposure to high temperatures, having a surface corresponding essentially identically to the surface of the applicator cylinder, and mounted so that it is pressed into engagement with the applicator cylinder to remove molten size and contaminants from the grooves of the applicator cylinder. The molten size with contaminants is diverted by the cleaner to a filter, which removes lint from the size and returns it to the trough.

30 Claims, 8 Drawing Figures

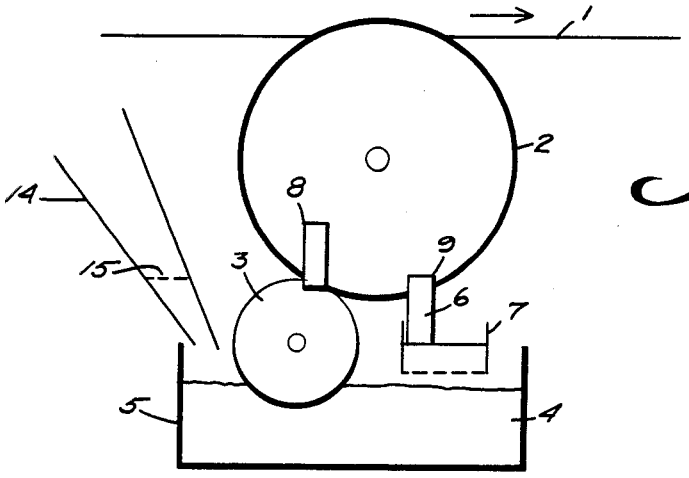
Fig. 1
Fig. 2
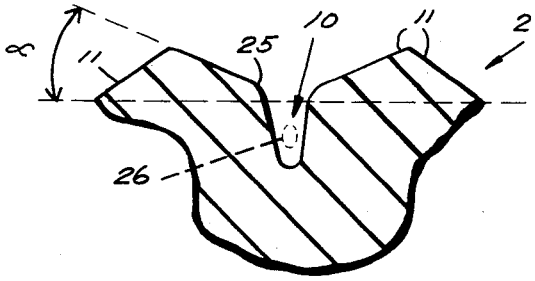
Fig. 6
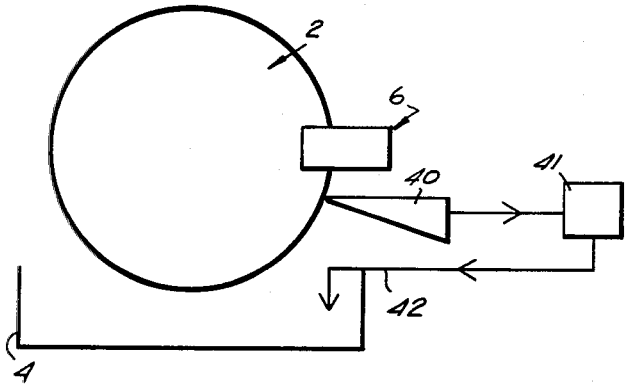
Fig. 8
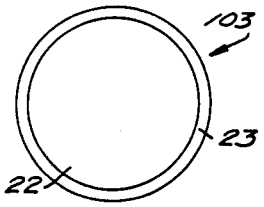

HOT MELT SIZE APPLYING

BACKGROUND OF THE INVENTION

The invention relates to a method and apparatus for applying molten size to a plurality of textile yarns.

Textile warp size is typically a polymeric material which is applied to individual textile yarns, whether filament or spun, to protect them from the physical abuse of the weaving operation. Although size could be applied to filling yarns, in practice the sizing of yarns for weaving is reserved exclusively for the treatment of warp yarns.

Commercial warp sizing machines, commonly known as slashers, in use today apply size to sheets of individual warp yarns in the form of aqueous solutions or suspensions. Aqueous slashing has other faults, but one of the most important and costly is the necessity to dry the sized yarns before they are wound up, i.e., beamed. With energy sources steadily rising in cost, drying of yarns is becoming a more and more expensive operation. The result is that means for supplanting aqueous slashing have for some time been sought in the trade.

During more than thirty years, repeated efforts have been made to develop sizes and means for applying them to yarn which would make the hot melt sizing of warp yarns commercially feasible. In Europe melt sizing is known as dry, i.e., solvent-free, sizing. Begun before 1950, developments originating with A. Hettwer in Austria culminated in the exhibition by the Swiss firm of Maschinenfabrik Ruti AG of a commercial dry sizing machine at the 1959 ITMA textile show in Milan. Sketchy information available today on the Ruti machine indicates that it featured a compressed-air size-doctoring device detailed in British Pat. No. 814,769 and elsewhere. No machine of this period seems to have been accepted by the trade, and the Ruti machine evidently had disappeared from the commercial scene by about 1962.

Shortly after Hettwer, in Swiss Pat. No. 308,545 (filed 1951), the German firm of Gebruder Sucker GmbH described an elaborate machine which evidently was intended for dry sizing of spun yarns. We have found no evidence that a size suitable for the machine was ever developed, or that the machine survived the fifties, if indeed it was ever commercialized.

Issued in 1969, U.S. Pat. No. 3,466,717 of Kuroda described a Japanese method and apparatus for the hot melt sizing of warp yarns with "a quickly solidifying size in which wax predominates". As with the Hettwer-Ruti machine before it, the Kuroda machine transferred molten size upward from a pool of size by means of one or more rollers to a sheet of warp yarns which picked up size from an upper roller surface as the roller turned. An emphasized feature of the Kuroda machine was a plurality of downstream smoothing, leveling or the like heated rollers, enclosed with the applicator roll within a preferably heated chamber, to provide even distribution of the size on the yarn before it passed to a cooling and solidifying zone. We are aware of efforts to commercialize this Japanese machine in the early seventies, but have heard nothing further of it in almost a decade.

Roughly coincident with the work in Japan, research on dry sizing methods and size compositions was going on in research institutes in eastern European countries, especially in East Germany and Poland. A section on "dry sizing" (pages 52–54) in a review article by Sontag (Deutsche Textiltechnik, 18, No. ½, 47–57 (1968)) briefly discussed work and problems to that time and introduced a laboratory dry sizing apparatus used at the Research Institute for Textile Technology, Karl-Marx-Stadt, East Germany. Difficulties encountered with sizing of spun (cotton) yarns are mentioned, but there is no indication that the problems were solved. This machine evidently was never commercialized. A later paper by Zawadzki ("Dry Sizing of Warps", Textiltechnik, 23, No. 7, 415–7 (1973)) described work on dry sizing at the Textile Research Institute in Lodz, Poland. A general discussion of the development of an industrial dry sizing machine and a diagrammatic sketch of the machine are given together with a statement that such a dry sizing machine had been installed in a filament weaving mill in Gorzow, Poland. We know of no further commercial developments along this line in the succeeding decade, however.

Careful study of the publications on these earlier melt, or dry, sizing systems shows that they achieved their only successes, however limited even they may have been, with filament yarns. With the exception of the Sucker patent, which directed attention principally to the dry sizing of spun yarns, all speak of spun yarn sizing only in terms of problems to be solved in the future. It is noteworthy that we have found no evidence of the further development or commercialization of the Sucker machine. Apparently, even in its own day it fell behind the Hettwer-Ruti machine, which was itself abandoned in the early sixties. In fact, apart from the following patent, and others utilizing its method and apparatus, we have found no evidence whatever of the commercialization of melt sizing of spun yarns, and no proof that the warp sizing of even filament yarns with melt sizes is being practiced commercially anywhere today.

In U.S. Pat. No. Re. 29,287, commonly assigned with the present application, a process and apparatus are described whereby molten size is applied to moving yarns as they pass tangentially through deep circumferential grooves in a heated rotating cylinder. After application the size solidifies almost instantly, without further manipulation in the molten state being either necessary or desirable. Although the process and apparatus of this patent may also be used to apply more thermally stable melt size compositions to yarn, a preferred embodiment is directed to applying sizes which, because of a tendency to thermal degradation, do not permit more than brief retention in the molten state. While not restricted to treatment of these yarns alone, the process and apparatus of this patent are concerned principally with the sizing of hairy spun yarns.

Inasmuch as most of the Swiss, Japanese, Polish, and German art references cited above are outwardly concerned only with problems seen in the melt sizing of filament yarns, they neither detail nor solve any problems which might have arisen with spun (staple) yarns. One of the most serious of such problems, in our experience, stems from the accumulation of fibrils, lint, and any other incidental debris, coming from either the yarn or from any other source, such as lint or dust in the atmosphere. (The Zawadzki reference above mentions such an atmospheric dust problem.) When such debris accumulates in the molten size it leads to nep-like lumps on the surface of the sized yarn, and subsequently to excessive yarn breaks in weaving.

Most prior art apparatus and methods for applying melt (or dry) size have been employed with various thermally stable waxes or waxy polymers such as polyoxyethylene glycol. As such they could afford not to be concerned with thermal degradation of the size while in the molten state. On the other hand the apparatus and method of U.S. Pat. No. Re. 29,287 had an additional capacity for sizing with compositions whose limited thermal stability did not permit long retention in the melt state.

The present invention provides advances in the method and apparatus of U.S. Pat. No. Re. 29,287. In particular it takes advantages of the concurrent development of melt size compositions having enhanced thermal stability.

SUMMARY OF THE INVENTION

Coincident with advances in melt size compositions suitable for sizing of yarns, especially of hairy spun yarns, an improved apparatus is provided according to the invention. Significant features of the apparatus include: a modified grooved applicator cylinder; a furnisher roll for forcing size into the grooves and preferably also for transferring size from a pool of melt to the applicator cylinder; a specially contoured cleaner device; means for providing a melt pool of limited dimension; and means for continuously removing lint from the molten size.

The actions of a deep-grooved applicator cylinder with sloped land areas between the grooves, a land-mating furnisher roll, and a precisely contoured groove- and land-fitting cleaner device combine with each other to provide the superior performance of the apparatus of the invention.

The invention seeks to provide an apparatus and method particularly having the capability to apply molten size of intermediate thermal stability to spun warp yarns. Such a degree of stability means that the size neither requires very rapid application after melting, nor permits the virtually unlimited holding in the molten state which has characterized many earlier melt sizes.

According to the present invention it is possible to effect application of hot melt size to textile strands, particularly spun yarn, in a more efficient manner. It is also possible to continuously remove unused size and accompanying solid materials (notably lint from spun yarn being sized) from the applicator cylinder lands and grooves, remove the lint from the unused size, and return the cleaned size to a melt supply system. Further according to the invention the volume of the molten size may be maintained small, thereby minimizing the thermal degradation of size if prone to such degradation when held too long in a molten state.

It is the primary object of the present invention to provide effective application of molten size to textile strands, particularly spun yarn. This and other objects of the invention will become clear from an inspection of the detailed description of the invention, and from the appended claims.

BRIEF DESCRIPTION OF THE DRAWINGS

FIG. 2 is a vertical sectional view of the circumferential grooves and sloping lands of the applicator cylinder of FIG. 1;

FIG. 6 is a schematic view of another exemplary embodiment of certain components of the apparatus according to the invention, showing a different form of filtering means;

FIG. 7 is a perspective view of a small-scale version of an apparatus according to FIG. 1; and FIG. 8 is a side schematic view of an alternative exemplary form the furnisher roller of the apparatus of FIG. 1 may take.

DETAILED DESCRIPTION OF THE DRAWINGS

Figure 1:
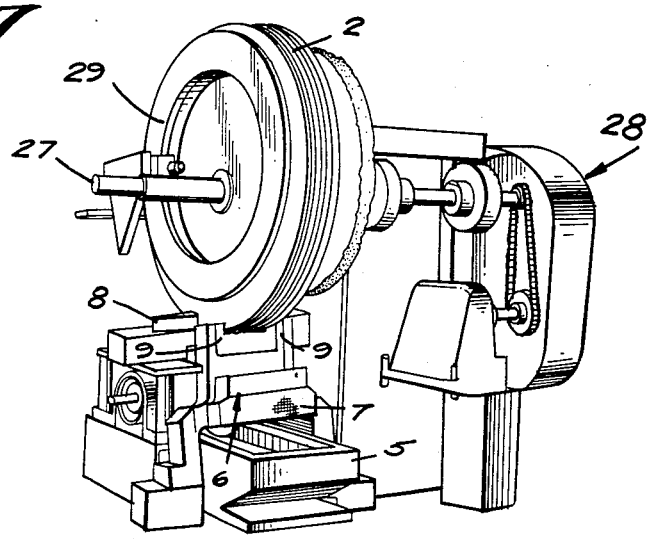
FIG. 1 is a diagrammatic sectional end view of exemplary apparatus according to the present invention.

The elements which differentiate the apparatus of the invention from the preferred embodiment of U.S. Pat. No. Re. 29, 287 (the disclosure of which is hereby incorporated by reference herein) are shown in FIG. 1. A sheet of warp yarns 1 passes across a limited arc of the deep circumferential grooves of heated applicator cylinder 2. The direction of yarn travel is preferably as shown, i.e., in the same direction as the rotation of the cylinder, although it may be reversed. Molten size is supplied to the surface of cylinder 2, and in particular is forced into its grooves, by unheated furnisher roll 3, which mates with the sloping land surfaces of cylinder 2. Roll 3 preferably contacts cylinder 2 at about its 7 o'clock position. Size is picked up by roll 3 from the pool 4 of molten size in heated trough 5. Residual size still on the cylinder after the zone of yarn contact is thoroughly stripped from cylinder 2 by groove- and land-fitting cleaner device 6. The size thus removed flows down the face 30 of cleaner device 6 into fine screen 7, or alternatively it may be caught in a gutter-like channel 40 (FIG. 6) associated with the face of the cleaner device, by which channel it is directed to an exterior filter for removal of lint and other solids. The filtered recovered size either drips back continuously from screen 7 into trough 5 or is returned as desired from the exterior filter (see FIG. 6). Depending upon how close the outer grooves in applicator cylinder 2 come to its two ends, suitable wiping blocks or dams 8 and 9 may be supplied as needed to confine the molten size on cylinder 2 to the immediate area of the grooves.

FIG. 7 shows a small-scale version of exemplary apparatus according to FIG. 1, with like reference numerals being directed to like structures. A central shaft 27 defines the axis of rotation of the roller 2, with a chain sprocket drive or the like 28 effecting rotation of the shaft 27 with mounted cylinder 2. Heat is applied to the cylinder 2 by a stationary electrically-heated ring 29 in mating, heat-transferring contact with the side surface of cylinder 2.

As best seen in FIG. 2, the surface of applicator cylinder 2 with its deep circumferential grooves 10 is essentially the same as that described in U.S. Pat. No. Re. 29,287 except for its sloping lands 11. These lands 11, each of whose corners with a groove wall is preferably rounded (see reference numeral 25), slope toward the grooves at an angle $\alpha$ of about 8°–12° from the horizontal (i.e. with respect to a plane bridging the entrance of associated groove 10), preferably about 9°–10°. Lands sloped in such fashion have been found to be more efficient than flat lands, particularly as they markedly aid in insuring the clean and dependable feeding of each strand in a warp sheet into its individual groove when the warp is lowered onto the applicator cylinder. Applicator cylinder 2 may be made of aluminum, but for longer wearing capability it is preferably made of stainless steel. The grooves 10 have a depth greater than the given diameter of a textile strand 26 cooperating therewith.

Figure 3:
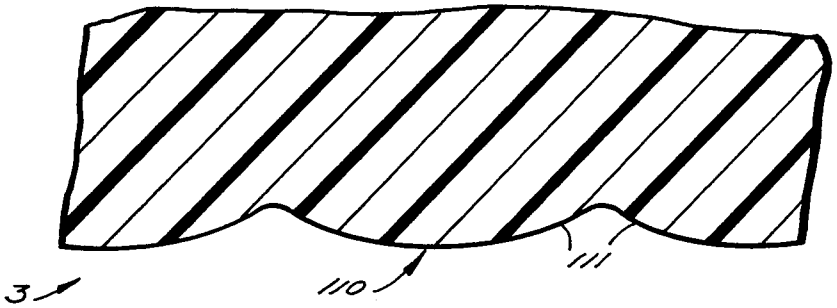
FIG. 3 is a sectional view of the surface of a preshaped furnisher roll, of FIG. 1.

Furnisher roll 3 may take either of two general forms: preshaped and pressure-deformable. FIG. 3 shows a portion of the surface of the preshaped type of roll in axial section. The roll may be made of any formable but substantially rigid synthetic polymeric material capable of lengthy exposure to the high temperature of the applicator cylinder and impervious to the softening action of the molten size, such as polytetrafluoroethylene (Teflon), aramid, polyamide-imide, polyetherimide, and the like. In a preferred embodiment roll 3 comprises a solid rod of Teflon having substantially the same length as the grooved surface of applicator cylinder 2. It is shaped, for example, by turning it on a lathe so that its sloping areas 111 mate with lands 11 of the applicator cylinder, and so that its substantially flat areas 110 bridge the entrances to the grooves 10, when cylinder 2 and roll 3 are pressed together as shown in FIG. 1.

Given an applicator cylinder about 255 mm in diameter, a laboratory-scale furnisher roll 3 may typically be about 75 to 130 mm in diameter, but neither dimension is critical. Also, besides being made from a solid cylinder of Teflon or the like, the furnisher roll may alternatively be made of a sleeve or tube of the polymer, surrounding a steel shaft and ground or turned down to the desired surface contour. Reinforcement with a faintly tapered steel shaft to allow for bowing under pressure is particularly important when a long roll, 125–155 cm in length for instance, is needed.

The pressure-deformable type of furnisher roll 103—see FIG. 8—most suitably takes the form of a tight-fitting layer or sleeve 23 of elastomer on a steel rod 22, the rod to give axial rigidity and the elastomer to provide appropriate continuous but fleeting mating of the furnisher roll with the turning applicator cylinder at the nip zone. The elastomer, momentarily distorted to conformity with the land areas of cylinder 2 in the nip, but bridging the entrances to the grooves, reverts to its normal essentially smooth and cylindrical surface as it leaves the nip.

The elastomer layer 23 is typically about 3–18 mm thick (exaggerated in FIG. 8 for clarity of illustration), preferably about 10 mm, surrounding a 105 mm steel rod when used with a 155 cm long furnisher roll 2. It may comprise any elastomer having the requisite flexibility, heat resistance, and resistance to swelling by the hot size. One such material is a silicone rubber having an intermediate Shore A durometer hardness of 45–60, as determined by Standard Test Method ANSI/ASTM D 2240-75.

As furnisher roll 3, 103, turns against rotating applicator cylinder 2 at the proper pressure, molten size is forced into grooves 10 to fill them continuously and smoothly. The remaining size pooled before the nip is squeezed and wiped away to leave the land areas 11 of cylinder 2 free of size beyond the nip. Having the lands clean at the point of yarn contact has been found very important to the smooth feeding of each yarn end into its proper individual groove.

In operation either type of furnisher roll, dipping into the melt pool and pressing against the grooved applicator cylinder, picks up size and transfers it to the surface of the cylinder. Roll 3 and cylinder 2, which turn in opposite directions as indicated by the arrows, may turn at the same or a higher surface speed, but experience has shown that better wiping of the lands and more regular filling of the grooves result when furnisher roll 3 turns at a slightly lower speed, such as 5–10 percent slower. With the speed different, provision must be made for dropping the furnisher roll away whenever it is not transferring size, to eliminate the severe frictional wear on the roll which running dry would produce.

It is important to provide for even and properly gauged pressure along the entire length of the nip. There are two obvious needs to be provided for. To avoid excessive roll wear, and also to avoid forcing the groove-bridging areas of the furnisher roll into the grooves, the pressure should be no greater than necessary. On the other hand the pressure must be high enough to insure clean wiping of the land areas, which essentially involves keeping size from passing beyond the nip in the land areas. One of ordinary skill in the art will readily be able to set the nip pressure to meet these needs.

Typical transfer rolls of the dry sizing art have a superficial similarity to the furnisher roll 3 of the invention. Earlier transfer rolls, however, depend upon the presence of a gap between them and the applicator roll and thus serve both as transfer rolls and as metering doctor rolls for determining how much size gets past them to the zone of yarn contact. They thus are incapable of performing a cleaning or wiping function on any part of the applicator cylinder.

In the invention it is important, to insure good performance and prevent size waste (which latter would occur with an additional conventional doctor or wiping blade for instance), that the grooves of the applicator roll be dependably and uniformly filled, but that the land areas be kept clean at the same time. This means that only the size pressed into the grooves at the nip of the rolls gets past the nip, while the land areas are wiped or squeezed clean at this point. Furnisher roll 3 thus comprises means for: transferring size from the size trough; filling the grooves with size; and keeping the lands wiped cleaned.

As is known per se in the aforementioned dry sizing art, a second roll, sometimes called a dipping roll, can optionally be used to move the molten size from size trough 5 to furnisher roll 3.

Most of the size which passes the nip of roll 3 and cylinder 2 is transferred to the yarn passing through the grooves at the top of the cylinder. The amount picked up can readily be controlled by balancing the nature and running speed of the yarn against the turning speed of cylinder 2 and the nature, particularly the fluidity, of the size. The remaining size, whether in the grooves or pushed out onto the lands by the motion of the yarn, is thoroughly cleaned from cylinder 2 by close fitting cleaner device 6. It is important for the proper functioning of the system that there be an excess of size over that taken up by the yarn, to insure a means for continuously entraining and scrubbing away all lint and other solids which otherwise tend to accumulate in the grooves of cylinder 2. In general the more hairy the yarn being sized, the more excess size is needed to entrain lint pulled or broken from it by the sizing operation.

Cleaner device 6, alone or acting in concert with either integral lint filter 7 or a separate external lint filter (FIG. 6), is the means for removing this lint and any other solid material in the size, such as dust picked up from the atmosphere. The cleaner device particularly described in U.S. Pat. No. Re. 29,287 depended for its effectiveness on the rotation of a series of plastic film washers or fins, one for each groove, reaching into the bottom of the grooves. The rotating washers either picked up and scattered the lint and residual size into the surrounding area, or kept the lint stirred up so that it was carried along in the size and transferred back to the yarn during succeeding turns of the grooved cylinder. The rotating type of cleaner was not very well suited to a method of melt sizing where a substantial portion of the melt is returned to its point of origin for recirculation.

The improved cleaner of the invention is of particular utility in the sizing of very hairy yarns, which are especially prone to shedding of lint. It may, if desired, be dispensed with in the sizing of less lint-prone yarns. Nevertheless, whatever the yarn, the fact that the improved cleaner provides a more positive cleaning action than the prior plastic washers cleaner makes it better suited to handling the larger amounts of size now being carried in excess on applicator cylinder 2 past the zone of contact with yarn 1. Not only does cleaning device 6 clean each groove 10 well, but it further provides means for diverting the residual size to filtering means 7, from which the filtered size returns to its source, pool 4 in trough 5 (see FIG. 1).

Figure 4:
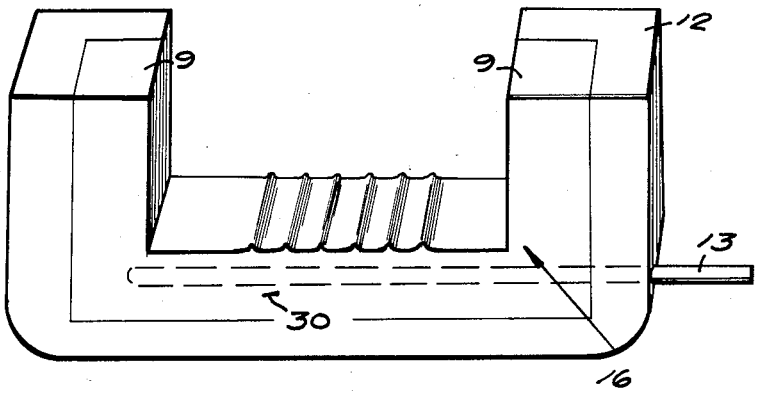
FIG. 4 is a view in perspective of a land- and groove-fitting cleaner device with optional integral end dams.

As best seen in FIG. 4, which depicts a laboratory-scale unit for cleaning a 6-groove applicator cylinder, the heart of cleaner 6 is a block or pad 16 of thermoplastic polymer or other suitable material, having a capacity for continuous use at high temperature, and also capable of being shaped into an exactly mated image of the grooved surface of applicator cylinder 2. As with furnisher roll 3, the groove-mating pad 16 in cleaner 6 may be made of heat-resistant thermoplastics such as aramid, polyamide-imide, polyetherimide, polybenzimidazole, and others having high continuous service temperature capability. Polytetrafluoroethylene (Teflon), with its 260° C. maximum continuous temperature rating, is the material of choice. Cleaner pad 16 may be integral with optional end dams 9 or it may be separate from the dams. If separate, the dams, whose shapeability and other physical requirements are much less rigorous, need not be made of the same material as cleaner pad 16. Small blocks of Teflon, however, are the material of choice for dams 9 too.

Cleaner pad 16 and integral dams 9 are adapted to be held in position against applicator cylinder 2—with projections 60 (see FIG. 5) mated with grooves 10—by a suitable mounting device 12, which is preferably made of steel or aluminum and is fitted for controlled movement of the cleaner and for regulating its pressure against grooved cylinder 2. Mounting device 12 also is provided with means for heating the cleaner, as by Calrod heater(s) 13, adapted to facilitate maintaining of size stripped from the cylinder 2 in molten form as it is diverted to filter 7 or the like. On machines for production sizing of large warp widths, such as those having 500–600 or more grooves for sizing a corresponding number of yarn ends, mounting device 12 must of course be sufficiently strong and rigid to insure the uniform holding and pressing of the elongated cleaner pad 16 against the surface of applicator cylinder 2, and it must be equipped with multiple heaters across its length.

Figure 5:
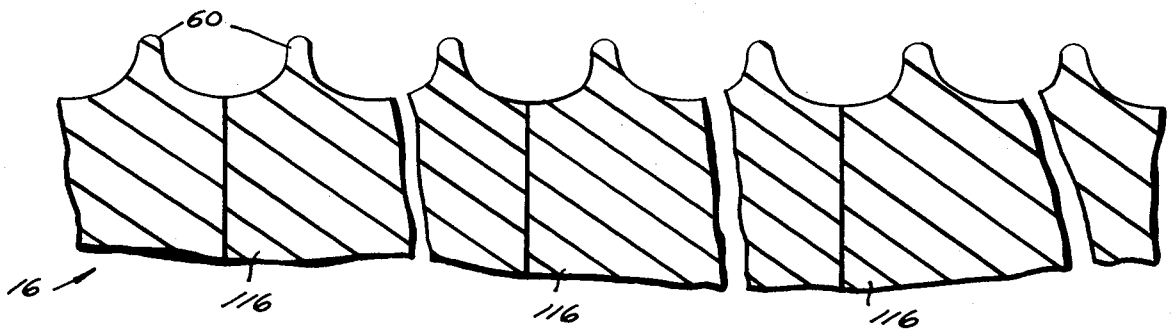
FIG. 5 is a greatly enlarged side view of the surface of the cleaning pad of FIG. 4.

On a production-scale machine it is important to allow for the difference in the thermal expansion of applicator cylinder 2 and cleaner device 6, and also to provide a safeguard against loss of the entire length of the cleaner pad 16 in case of an accident involving a groove or a portion of the cleaner. It is thus preferred to employ multiple short sections 116 of pad 16 held side-by-side by mounting device 12 across the length of applicator cylinder 2. FIG. 5 schematically depicts only 3 sections of the much longer pad 16, the projections 60 in each section mating with about 20 grooves in the applicator cylinder. Sections 116 of cleaner pad 16 are about 5 cm long, and are located a fraction of a millimeter apart to allow for thermal expansion, provide the desired thermal character, and provide individual replaceability. Each junction between successive sections 116 preferably occurs as near as possible to the bottom of a valley in the cleaner device opposite the peak of a sloping land 11. The individual sections are fixed in a line against the surface of mounting device 12 by the surface tension of the molten size. They are thus free to shift slightly sidewise on the mounting device to permit exact mating of each contoured cleaner section with the corresponding grooves on applicator cylinder 2 whenever they are brought together.

At each end of a production machine, employing multiple cleaner pad sections 116, optional end dams 9 may be either integral with or separate from the outermost cleaner section 116. It will be obvious that while the dams are shown in FIG. 4 as employed mostly for keeping the disc ends of the applicator cylinder 2 wiped free of size, on a large machine they can also be engineered, if so needed, to clean only the circumferential end surfaces beyond the outermost grooves when these do not come close to the end of the cylinder.

The precise mating of the surface of cleaner pad 16, whatever may be its length, with the grooved surface of applicator cylinder 2, and the steps needed to insure maintenance of this mating at start-up or after breaks in the sizing process, shutdowns, and the like, are important. Although it should be possible to approach an exact mating by rough machining of the pad surface and then to complete the mating by wear-in, we have found that one of the most practical ways to effect the desired precision of mating is to press heated cleaner 6, with blank Teflon pad 16 attached in place in mounting device 12, against hot turning applicator cylinder 2. Taking account of the temperature conditions to be employed with a typical melt size, one may for example heat cylinder 2 at about 185° C. and mounting device 12 at about 165° C., press them together at about 4.2 $kg/cm^2$, and turn the cylinder for several hours until the pad sections take the contour of the cylinder surface. Thereafter, in actual use for sizing, the cleaner may be routinely disengaged and slowly re-engaged, while maintaining substantially the same temperature and pressure conditions as before, to achieve the same precise mating of the surfaces and the desired continuous cleaning of the grooves. On the whole, once the original contouring of the cleaner to the surface of grooved cylinder 2 has been effected, no more than reasonable care in engaging and disengaging the surfaces will be needed to preserve the precision of mating.

To preserve the precision of the mating, both the cylinder and the cleaner should be heated to their operating temperatures before they are brought each time into engagement. Also, while conditions suitable for cleaner pads 16 made of Teflon have been detailed herein, one of ordinary skill can easily determine conditions suitable for cleaner pads made from materials other than Teflon. Additionally, should a change of size to be applied result in a really substantial increase or decrease in the temperature of size application, a fresh mating of the surfaces at the new temperature before cleaning is attempted could be effected. Under normal conditions, however, it is believed that a single mating is applicable over a wide range of practical application temperatures.

The molten size stripped from applicator cylinder 2 by cleaner 6 may be diverted to a separate filter for removal of lint and other solids before being returned to melt body 4. As is true of many organic compositions, it is not uncommon for melt sizes to undergo chemical and corresponding physical changes on lengthy heating. It is generally preferable, therefore, to filter the unused size immediately through optional attached lint filter 7 and return the filtrate directly to melt body 4. The principal objective and effect of this procedure is to minimize the average time the size is held in the molten state before it is taken up by the yarn and removed from further heating. Filter 7 may take any suitable form alongside the drainage face 30 of cleaner 6, such as that of the L-shaped stainless steel fine screen outlined in FIG. 1 (60-mesh, for example). Its filtering area may also be increased by making the screen U-shaped, so that it underhangs cleaner 6, as shown by dotted lines in FIG. 1, without requiring any enlargement of melt trough 5 below it. Conventional means may be utilized for removing lint from the screen as it gradually fills with solid.

Where the size stripped off by cleaner 6 is to be diverted to a separate external filter 41, cleaner 6 can be located anywhere downstream from the zone of yarn contact at the top of applicator cylinder 2 and before the location of furnisher roll 3, such as at the 3 o'clock position as illustrated in FIG. 6. When the size flows across the face of cleaner 6 and into filter 7 and from there drops directly back into melt body 4, it is preferable to place cleaner 6 as close as possible to furnisher roll 3, i.e., near the 6 o'clock position (FIG. 1). This consolidation of positions has the desired effect of helping decrease the size of melt body 4 by reducing its width, i.e., the dimension underlying furnisher roll 3, applicator cylinder 2, and cleaner 6 as seen in FIG. 1. A pool width of about 20 cm has been found sufficient to accommodate drip-back from the applicator and cleaner components, plus providing space for heated size feed hopper 14 with its fine screen 15 (60-mesh for example). Solid size composition is fed to hopper 14 at a rate which insures fresh filtered melt being added to melt body 4 fast enough to make up for the size taken up by the yarn, while maintaining a preferably shallow (15 to 30 mm) body of melt in trough 5. Heaters in trough 5 hold melt body 4 at as low a temperature as is required to insure a plentiful supply of size to applicator cylinder 2 by way of furnisher roll 3. Feed hopper 14 and trough 5 extend across the entire length of the assembly. Under these conditions the molten size is held at full applicator cylinder 2 temperature for only a short time on the average, and the size being supplied to the cylinder is kept moving steadily to prevent stagnant zones and corresponding long retention in the melted state.

In the embodiment illustrated in FIG. 6, molten size removed from the grooves of roller 2 by cleaner 6 is diverted to catching pan or channel 40. The melted size from pan 40 is passed (e.g. pumped) to filter 41, and from filter 41 it passes through pipe 42 back to trough 4, ultimately to be picked up by furnisher roller 3 (not illustrated in FIG. 6).

Regardless of the size of melt body 4, it is desirable to provide suitable conventional means for continuous recirculation, filtering, and, to such extent as may be needed, stirring of the melt, to provide protection against either melt separation or the accumulation of foreign material in the melt in the course of long runs.

By utilizing the combination of the improved apparatus of the invention and the conditions proposed for its use, one may apply melt size effectively to spun yarns which otherwise lead to unacceptable accumulations of lint in the melt. Even in the absence of substantial problems with linting, the improved apparatus and methods of the invention substantially advance the art of melt sizing and make it more industrially attractive.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent apparatus and methods.

What is claimed is:

1. Apparatus for applying sizing material to a plurality of textile strands, comprising: an applicator cylinder having a grooved exterior circumferential surface and mounted for rotation about a first axis; means for applying melted sizing material to said cylinder so that size is lodged in said grooves thereof; means for rotating said cylinder about said first axis so that size in said grooves is applied to textile strands each moving past said cylinder and traveling for at least a short distance in a groove; means for cleaning the grooves in said grooved cylinder, comprising a pad having a plurality of integral projections formed thereon substantially identical to the grooves formed in said cylinder, said pad made of material having a capacity for continuous use at high temperature; and means for mounting said pad and holding said pad in contact with said cylinder during rotation thereof so that said projections on said pad enter said cylinder grooves, remaining stationary in said grooves and effecting cleaning thereof.

2. Apparatus as recited in claim 1 wherein said pad is of thermoplastic material capable of being shaped into an exactly mated image of the grooved exterior circumferential surface of said applicator cylinder.

3. Apparatus as recited in claim 2 wherein said pad is of polytetrafluoroethylene.

4. Apparatus as recited in claim 1 further comprising means for filtering molten size stripped from said applicator cylinder by said pad, and returning said filtered size to said size applying means; and wherein said pad further comprises means for diverting molten size stripped from said applicator cylinder to said filtering means.

5. Apparatus as recited in claim 4 further comprising means for heating said cleaning means to maintain it at a temperature sufficient to facilitate maintaining molten size diverted thereby in molten form.

6. Apparatus as recited in claim 5 further comprising dam means formed with said pad for operative engagement with end faces of said applicator cylinder to facilitate cleaning thereof.

7. Apparatus as recited in claim 5 wherein said pad comprises a plurality of sections.

8. Apparatus as recited in claim 5 wherein said pad mounting means comprises a metal mounting block, and wherein said means for heating said cleaning means comprises at least one electric resistance heating element disposed in said metal mounting block.

9. Apparatus as recited in claim 4 wherein said means for applying the sizing material comprises a trough of sizing material, and a furnisher roll rotatable about a second axis spaced from, but essentially parallel to, said first axis, so that a portion of said roll is within said bath; wherein said filtering means comprises a filtering mechanism directly connected to said cleaning means and disposed directly above said trough so that melted size diverted to said filter means from said cleaning means passes therethrough and then drops directly into said trough.

10. Apparatus as recited in claim 1 wherein said applicator cylinder grooved surface includes lands, and wherein means for applying the sizing material to said cylinder comprises: an open-top trough of melt; and a furnisher roll mounted for rotation about a second axis generally parallel to, but spaced from, said first axis; said furnisher roll comprising means for transferring size from said trough, filling the grooves in said applicator cylinder with size, and wiping clean said lands of said applicator cylinder.

11. Apparatus as recited in claim 10 wherein said furnisher roll has a preshaped circumferential surface portion having sloping areas which mate with lands of said applicator cylinder, and having flat areas which bridge entrances to grooves of said applicator cylinder when said roll and applicator cylinder are pressed together, said surface of said roll being of substantially rigid material.

12. Apparatus as recited in claim 11 wherein said roll surface is of substantially rigid synthetic polymeric material capable of lengthy exposure to high temperature and impervious to the softening action of molten size.

13. Apparatus as recited in claim 12 wherein said roll surface material is polytetrafluoroethylene.

14. Apparatus as recited in claim 11 wherein said applicator cylinder comprises sloping lands peaking between each groove.

15. Apparatus as recited in claim 14 wherein said sloping lands slope toward each respective groove at an angle of about 8°–12° with respect to a plane bridging the entrance of the respective groove.

16. Apparatus as recited in claim 15 further comprising rounded corners between said grooves and said lands.

17. Apparatus as recited in claim 10 wherein said furnisher roller comprises a solid cylinder of rigid material with an external sleeve covering the circumferential surface of said cylinder, said external sleeve comprising a pressure-deformable material having sufficient flexibility to deform to generally conform to the configuration of said applicator cylinder grooved surface, and having sufficient heat resistance and resistance to swelling by hot size for continued operation.

18. Apparatus as recited in claim 17 wherein said pressure-deformable sleeve of said furnisher roll comprises an elastomeric material such as silicone rubber.

19. Apparatus as recited in claim 11 wherein said cleaning means pad is made of a thermoplastic polymeric material selected from the group consisting essentially of polytetrafluoroethylene, aramid, polyamide-imide, polyetherimide, and polybenzimidazole.

20. Apparatus as recited in claim 1 wherein said pad comprises a plurality of sections.

21. Apparatus as recited in claim 2 wherein said pad comprises a plurality of sections.

22. Apparatus as recited in claim 3 wherein said pad comprises a plurality of sections.

23. Apparatus for applying sizing material to a plurality of textile strands, comprising: an applicator cylinder having a peripheral closed surface defined by a plurality of alternating grooves and lands, said grooves and lands extending circumferentially about said peripheral closed surface; said lands peaking between said grooves and sloping from said peaks to grooves on either side thereof to aid in insuring proper feeding of each strand in a warp sheet into an individual groove in said application cylinder, each said land making an angle of about 8°–12° with respect to a plane bridging the entrance of a respective groove; said applicator cylinder rotatable about a first axis of rotation; means for applying sizing material to said applicator cylinder so that size is lodged in said grooves; and means for rotating said applicator cylinder about said first axis so that size in said grooves is applied to textile strands moving past said cylinders and traveling for at least a short distance in a said groove immersed in size in said groove so as to pick up size in that groove;

said means for applying the sizing material to said cylinder comprising: an open-top trough of melt; and a furnisher roll mounted for rotation about a second axis generally parallel to, but spaced from, said first axis; said furnisher roll comprising means for transferring size from said trough, filling the grooves in said applicator cylinder with size, and wiping said cylinder lands clean, and said furnisher roll having a preshaped circumferential surface portion having sloping areas which mate with lands of said applicator cylinder, and having flat areas which bridge entrances to grooves of said applicator cylinder when said roll and applicator cylinder are pressed together, said surface of said roll being of substantially rigid material.

24. Apparatus as recited in claim 23 wherein said corners between said lands and grooves are rounded.

25. Apparatus as recited in claim 23 wherein said roll surface is of substantially rigid synthetic polymeric material capable of lengthy exposure to high temperature and impervious to the softening action of molten size.

26. Apparatus for applying sizing material to a plurality of textile strands, comprising: an applicator cylinder having a plurality of grooves extending therein circumferentially about the peripheral closed surface thereof, with lands between the grooves; means for applying sizing material to said cylinder so that size is lodged in said grooves thereof; means for rotating said cylinder about a first axis so that size in said grooves is applied to textile strands each moving past said cylinder and traveling for at least a short distance in a groove; said means for applying sizing material to said cylinder comprising: an open-top trough; a furnisher roller rotatable about a second axis generally parallel to, but spaced from, said first axis; said furnisher roller comprising means for transferring size from said trough to said applicator cylinder grooves, filling the grooves with size, and keeping the lands between the grooves of said applicator cylinder wiped clean, and said furnisher roll having a preshaped circumferential surface portion having sloping areas which mate with the lands of said applicator cylinder, and having flat areas which bridge entrances to grooves of said applicator cylinder when said roll and applicator cylinder are pressed together, said surface of said roll being of substantially rigid material.

27. Apparatus as recited in claim 26 wherein said roll surface is of substantially rigid synthetic polymeric material capable of lengthy exposure to high temperature and impervious to the softening action of molten size.

28. A method of effecting cleaning of an applicator cylinder having a plurality of grooves therein extending circumferentially about the peripheral closed surface thereof with lands between said grooves, utilizing a pad of thermoplastic polymeric material comprising the steps of:

heating the pad and applicator cylinder;

while rotating the hot applicator cylinder, bringing the pad into contact therewith, under pressure, for a sufficient length of time for the pad surface to take the contour of the cylinder surface;

once the cylinder surface and pad surface mate, supplying molten size to said applicator cylinder grooves;

removing a portion of the size from said applicator cylinder grooves by passing spun yarn, or like textile strands, into operative association therewith; and effecting mating of said cleaning pad and applicator cylinder at an area past the point where spun yarn or like textile strands remove molten size from said grooves to effect cleaning of said applicator cylinder.

29. A method as recited in claim 28 wherein said steps of heating said cylinder and pressing the cylinder and pad together are accomplished by heating said cylinder to a temperature of about 185° C., and pressing said pad and cylinder together at a pressure of about 4.2 kg/cm$^2$.

30. A method as recited in claim 28 comprising the further step of diverting molten size removed from said grooves by said cleaner to a filtering means; effecting filtering of the molten size with said filtering means to remove lint, and the like therefrom; and returning the filtered molten size for use to be applied to said applicator cylinder grooves again.

* * * * *